United States Patent [19]

Krieger et al.

[11] Patent Number: 4,676,698

[45] Date of Patent: Jun. 30, 1987

[54] HYDRAULIC VALVE CONTROL APPARATUS

[75] Inventors: Karl Krieger, Wuppertal; Werner Reinelt, Bochum, both of Fed. Rep. of Germany

[73] Assignee: Hermann Hemscheidt Maschinenfabrik GmbH & Co., Wuppertal, Fed. Rep. of Germany

[21] Appl. No.: 698,589

[22] Filed: Feb. 5, 1985

[30] Foreign Application Priority Data

Feb. 8, 1984 [DE] Fed. Rep. of Germany ..... 3404302

[51] Int. Cl.[4] ..... E21D 23/16; E21D 23/26

[52] U.S. Cl. ..... 405/302; 405/291; 91/524; 91/527

[58] Field of Search ..... 405/291, 292, 299, 302; 91/170 MP, 524, 527, 530

[56] References Cited

U.S. PATENT DOCUMENTS

| | | | |
|---|---|---|---|
| 3,309,880 | 3/1967 | Potts et al. | 405/302 |
| 3,434,389 | 3/1969 | Grisebach | 91/524 X |
| 3,500,719 | 3/1970 | Rieschel | 91/524 X |
| 3,906,738 | 9/1975 | Weirich et al. | 405/302 |
| 3,967,534 | 7/1976 | Cryder et al. | 91/524 X |
| 4,394,875 | 7/1983 | Weirich et al. | 91/170 MP |
| 4,572,709 | 2/1986 | Weirich et al. | 91/170 MP X |

FOREIGN PATENT DOCUMENTS

| | | | |
|---|---|---|---|
| 2118689 | 11/1983 | United Kingdom | 405/302 |

*Primary Examiner*—Cornelius J. Husar
*Assistant Examiner*—Nancy J. Stodola
*Attorney, Agent, or Firm*—Berman, Aisenberg & Platt

[57] ABSTRACT

Valves regulating the supply of hydraulic fluid to hydraulic cylinders of an hydraulic walking mine-roof support are controlled by apparatus comprising an axially-movable switching shaft provided with cams which is rotatable into successive switching stations where it is immobilized by spring-loaded stop pins to that the cams bear on tappets to actuate the respective valves, there being a switching spring acting on the shaft to return the shaft to its initial position of rest after it has been axially displaced and rotated out of that position of rest.

14 Claims, 5 Drawing Figures

II
II

IV
IV

HYDRAULIC VALVE CONTROL APPARATUS

This invention relates to hydraulic valve control apparatus and is especially concerned with apparatus for hydraulically controlling a walking mine-roof support. .

The aim of the invention is to provide control apparatus whereby the operations performed by an hydraulic walking mine roof support can be remote-controlled and proceed in an automatic sequence.

By way of background information, attention is drawn to DE-AS No. 12 01 286 which discloses apparatus for the hydraulic control of a walking mine-roof support wherein the setting sequence is initiated by an electrical control impulse. This imparts rotation to a switching shaft on which are arranged spaced-apart switching cams which are angularly offset from each other to a specific extent. The rotary movement of the switching shaft causes the cams to be brought in sequence into an actuating position, in which they each actuate a switching lever of a respective valve associated with the walking mine-roof support. A disadvantage of this system, however, is that the switching sequence initiated by the control signal proceeds mechanically in an uncontrolled manner, with the result that the various operations will be initiated even when the operating pressure necessary for carrying out the switching operations is not available in the hydraulic pressure-supply line. A drop in pressure in the hydraulic pressure-supply line can result in the walking mine-roof support not being advanced sufficiently and being reset when the roof-supporting force provided by the hydraulic props or rams of the support is inadequate so that the safety of the gallery, mine-road or working face is jeopardized.

It is therefore the purpose of the present invention to increase safety during actuation of a walking mine-roof support during a switching sequence while using simple means for this purpose. More specifically, it is the intention of the invention to ensure that the initiated operations are carried out completely except when the pressure in the hydraulic pressure-supply line is insufficient, in which case the switching sequence is not started up or an already initiated switching sequence does not proceed further.

With this consideration in mind, the invention is directed to apparatus of the construction defined in claim 1 of the present specifications.

Control apparatus in accordance with the invention therefore meets the safety requirements in mines more fully than the prior apparatus described above. In particular, the switching sequence is not started up by a weak setting impulse since the force of the switching spring is not overcome by a weak impulse. Nor is the sequence initiated if the pressure in the pressure-supply line is too low. Each spring-loaded stop pin, which preferably engages in a longitudinal groove formed in the switching shaft, releases the shaft to allow it to rotate only when the pressure passed from the hydraulic pressure-supply line into a pressure chamber associated with the respective stop pin displaces that pin against the force of its loading spring. If the pressure drops again during the initiated switching sequence, the switching shaft is again rotated in the reverse direction by the stop pin under the force of its loading spring and is pushed back into the initial position by the switching spring. The switching sequence is thus interrupted. It must then be started up again by a fresh control impulse. This prevents an initiated switching sequence from being interrupted only temporarily when a drop in pressure occurs and then starting up again in an uncontrolled manner when the pressure rises. The switching sequence starts up only after the supplied control signal has died out, and it then proceeds automatically with a constant switching force provided the required operating pressure occurs in the hydraulic pressure-supply line. The spring-loaded hydraulically-movable stop pins also ensure that the initiated switching operations are always carried out in the correct sequence and that a fresh operation is initiated only upon completion of the preceding one.

By means of a safety line laid in the gallery or mine road, each switching sequence that has been brought into action can be switched off again at any point along the gallery. The switching shaft is then rotated from the switched position in the opposite direction by the pressure applied to the switching piston of the corresponding stop pin, and the shaft is returned to the initial position by the switching spring.

An example of control apparatus in accordance with the invention is illustrated in the accompanying drawings, in which.

Figure 5:
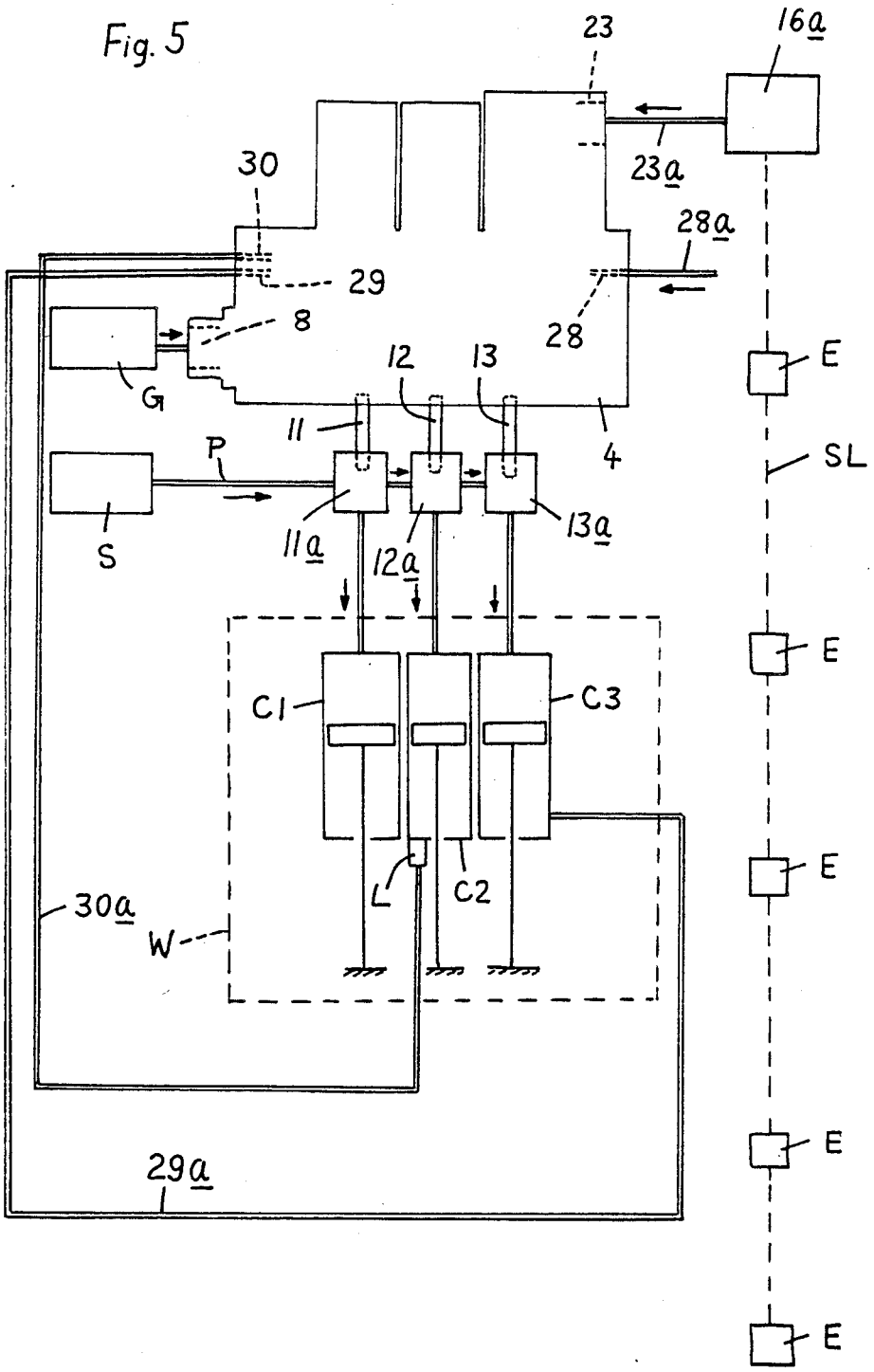
FIG. 5 is a diagrammatic view of a mine-roof support incorporating the control apparatus.

The illustrated hydraulic valve control apparatus has a switching shaft 1 provided at each of its ends with a collar 2, the shaft being accommodated in a bore 3 in the housing 4 of the apparatus. A switching spring 5 fitted in the innermost part of the bore 3 engages in an axial bore 6 formed in the inner part of the switching shaft 1, the outer end of the spring being arranged to bear against an annular shoulder on a centering pin 7 within the bore 6. Located in the outer end portion of the switching shaft 1 is a switching piston 9 having a connecting sleeve 8 inserted in the outer end of the bore 3, the switching piston 9 being provided to allow control signals to be applied to the switching shaft 1. Arranged longitudinally of the switching shaft 1 on its outer surface are three spaced-apart switching cams 10 in the form of trapped balls for actuating the tappets 11, 12, 13 of multi-port valves 11*a*, 12*a*, 13*a* (see FIG. 5) whereby pressurized hydraulic fluid from a pressure-supply line P connected to a source S of such fluid is passed to the working cylinders C1, C2, C3 of a walking roof-support W. In the illustrated form of construction, a valve 11*a*, 12*a*, 13*a* is provided for each of the operations of prop withdrawal, walking and setting of the mine-roof support.

An hydraulic control signal from a signal generator G (see FIG. 5) applies a predetermined pressure to the switching piston 9 so as to displace the switching shaft 1 in an axial direction against the switching spring 5 which is prestressed, i.e. under compression in its initial state. During this displacement, the switching shaft 1 is rotated through a small arc by a peg 14 which is secured in the housing 4 and engages in a recess 15 of parallelogram shape formed in the outer surface of the switching shaft 1. The peg 14, which at the end of the shaft displacement bears against an inclined guide face of the recess 15, turns the switching shaft 1 about its longitudinal axis into a position in which the switching cams 10 on the shaft 1 are located in the same plane as the tappets 11, 12, 13 of the multi-port valves. Such rotation of the switching shaft can, however, be blocked by a stop pin 16 which, together with two further stop pins 17 and 18, is arranged in the housing 4 on that side of the switching shaft 1 opposite to the tappets 11, 12, 13. The stop pins 16, 17, 18 are acted upon, at their ends remote from the switching shaft, by respective helical compression springs 19, 20, 21 which, however, are rated differently from each other in accordance with the differing functions of the stop pins 16, 17, 18. The stop pin 16 can also be acted upon by hydraulic pressure medium supplied from an outside source 16*a* (see FIG. 5) and applied to the pin by means of a switching piston 22 by way of a connection 23 and a pipe-line 23*a*. The spring 19 presses the lower end of the stop pin 16 into a longitudinal groove 24 which is formed in the switching shaft 1 eccentrically of its axis of rotation. The pin 16 thereby blocks rotation of the shaft until the pressure in the pressure-supply line 23, 23*a* exceeds the minimum level preset by the spring 19.

Figures 1, 2:
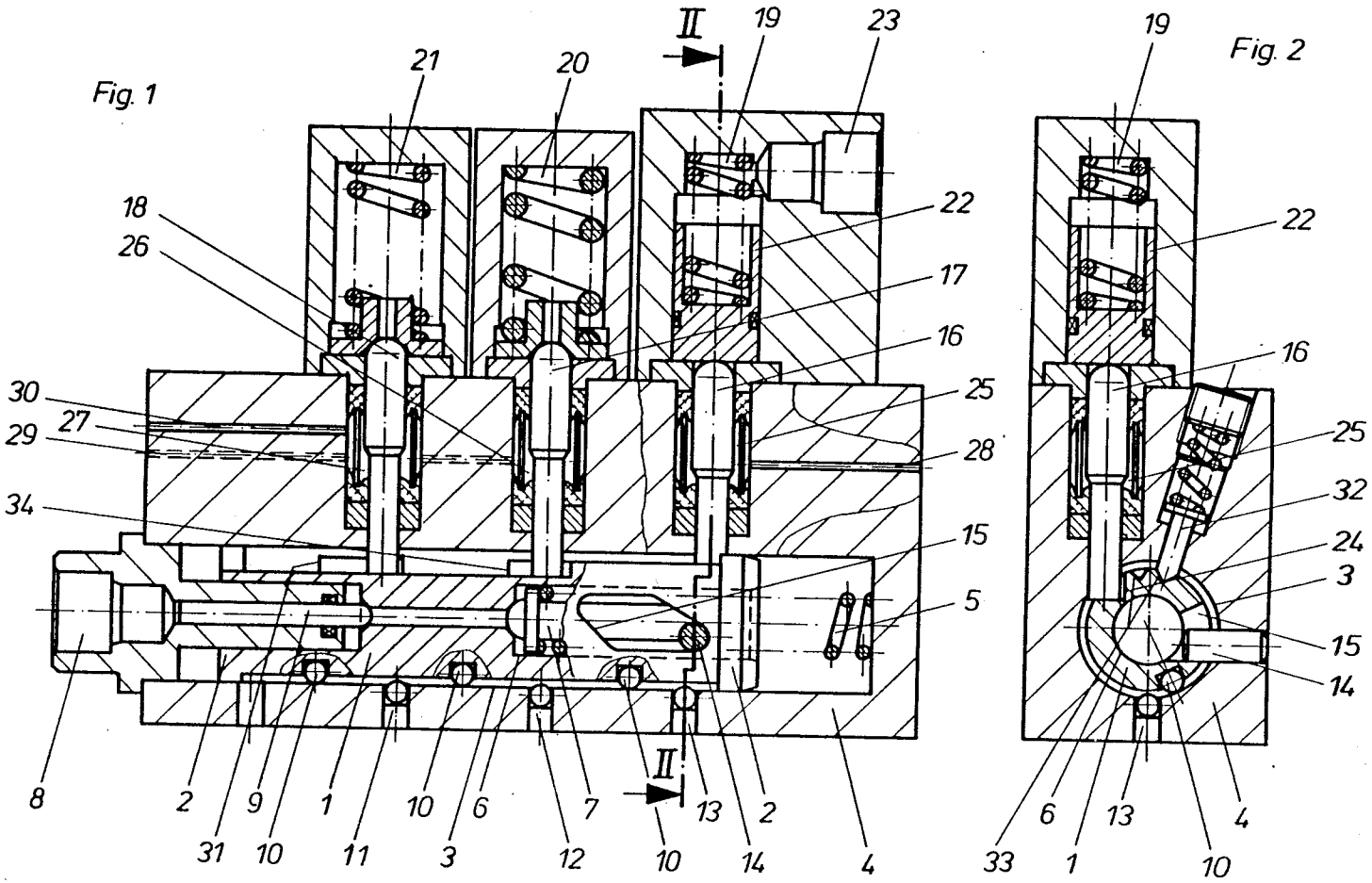
FIG. 1 is a longitudinal section through the control apparatus with its switching shaft located in the starting position.
FIG. 2 is a section taken on the line II—II in FIG. 1.
Figures 3, 4:
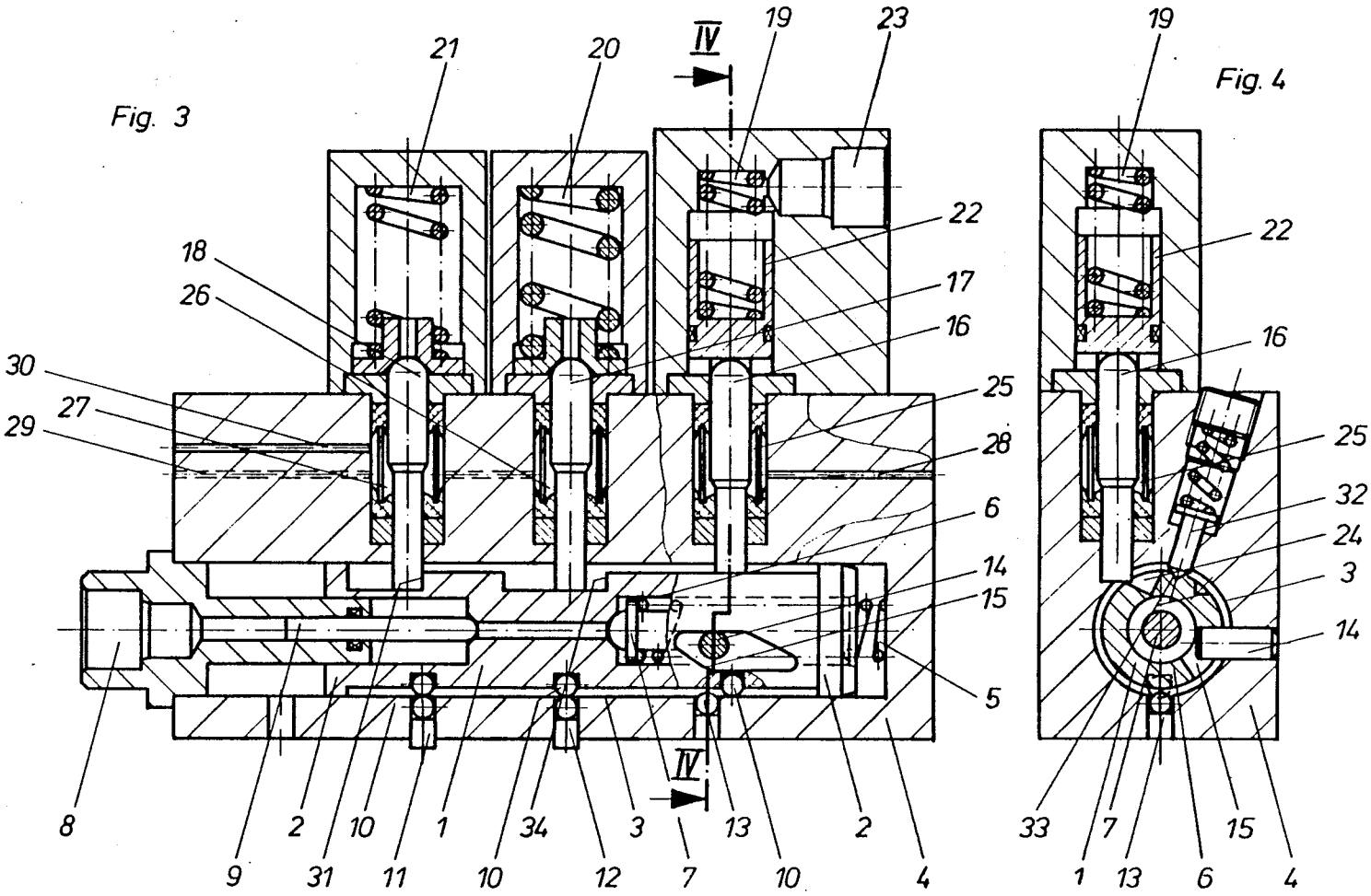
FIG. 3 is a longitudinal section similar to FIG. 1 with the switching shaft rotated into the working position.
FIG. 4 is a section taken on the line IV—IV in FIG. 3.

The stop pins 16, 17, 18, which are all of the same contour, have stepwise reduced stems which increase in cross-section towards the respective compression springs 19, 20, 21. The mid-portions of the pins are located in pressure chambers 25, 26, 27, respectively, which surround the mid-portions of the stems in a fluid-tight manner, the stop pins being acted on by pressurized hydraulic fluid which enters the said pressure chambers by way of channels 28, 29, 30 respectively. The pressure acting on the stepped surfaces of the stems displaces the stop pins 16, 17, 18 against the force of the compression springs 19, 20, 21 respectively. The pressure chamber 25 of the stop pin 16 which engages in the longitudinal groove 24 is connected through the duct 28 to a pressure-supply line 28*a* so that where sufficient pressure is applied, the stop pin 16 lifts out of the longitudinal groove 24 against the force of the compression spring 19 (see FIG. 4) and releases the switching shaft 1 so that it can rotate into the switching position.

The shaft 1, on being rotated into the switching position by a control signal and the peg 14, is pushed by the tensioned spring 5 into a first switching station. When this happens, the spring-loaded stop pin 18 encounters a shoulder 31 on the shaft 1 and immobilizes the latter. In the first switching station, two of the switching cams 10 provided on the shaft 1 are disposed above the tappets 11 and 12, so that the multi-port valves 11*a* and 12*a* for prop withdrawal and walking of the mine-roof support W are actuated. During displacement, the switching shaft 1 is guided in the axial direction by a spring-loaded guide pin 32 which is directed radially on to the shaft and, depending upon the particular rotary position of the shaft, engages in one of the two longitudinal grooves 33 of V-shaped cross-section which extend parallel to each other along the outer surface of the shaft.

As soon as the initiated walking operation of the mine-roof support has been carried out, an hydraulic control signal which indicates that this has happened and which emanates from a limit switch L on the walking cylinder C2 is passed through a line 30*a* and the duct 30 into the pressure chamber 27 and to the stop pin 18. This pin is thereby lifted by the fluid against the force of the compression spring 21, and the switching shaft 1, biassed by the spring 5, moves into the second switching station in which the middle stop pin 17 bears against a shoulder 34 on the shaft 1. In the second switching station, the tappet 13 of the valve 13*a* controlling the setting operation is pressed into the switching position by the corresponding cam 10 on the shaft 1. The compression chamber of the hydraulic ram or cylinder C3 is connected, by way of a line 29*a* and the duct 29, to the pressure chamber 26 surrounding the mid-portion of the stop pin 17. The compression spring 20, acting on the stop pin 17, is so highly rated that the said pin is lifted only when the above-described setting pressure has built up in the compression chamber of the ram. The setting operation is terminated by the lifting of the setting pin 17 under the pressure of fluid in the chamber 26, whereupon the switching shaft 1, under the action of the spring 5, is rotated by the peg 14 bearing against the inclined guide faces of the recess 15 and is returned to its initial position.

If, during a switching phase, the pressure in the respective pressure-supply line drops below the required operational level and if the pressure applied to the differential stepped surface of the stop pin 16 diminishes to such an extent that the force of the compression spring 19 predominates, then the switching shaft 1 is turned from the switching position by the stop pin 16 which engages in the longitudinal groove 24. The tensioned spring 5 then pushes the switching shaft 1 back into its unloaded initial position. However, the switching sequence can be started up at full operating pressure from any switching station and by way of the stop pin 16 if the piston 22 is acted upon by pressurized fluid by way of the connection 23. For this purpose there are provided emergency cut-out switches E which, at any required point along the gallery or mine road, are connected to a safety line SL provided for the purpose.

We claim:

1. Apparatus for controlling hydraulically a plurality of multi-port valves connected to a high-pressure line for admitting a pressurized hydraulic medium to hydraulic cylinders of a walking mine-roof support, said apparatus comprising a housing accomodating an axially-displaceable switching shaft, shaft-displacing means in the housing arranged to displace the switching shaft in an axial direction out of an initial rest position in response to a control signal applied to the shaft-displacing means, switching cams on the shaft arranged to actuate respective switching tappets of the multi-port valves in a predetermined sequence, a switching spring acting on the shaft to urge the shaft into the initial rest position whereby the shaft-displacing means displace the shaft axially against the action of the switching spring, shaft-rotating means in the housing to rotate the shaft into a plurality of switching positions wherein the switching cams on the shaft lie in the same plane as the switching tappets of the multi-port valves, and a plurality of spring-loaded hydraulically-releasable stop pins to hold the rotated switching shaft in each switching position, the shaft being displaceable stepwise, after the shaft has been acted on by the shaft-displacing means and the shaft-rotating means, back to the initial rest position under the action of the switching spring, the switching tappets being actuated by the cams during such stepwise displacement of the shaft.

2. Apparatus according to claim 1, wherein the switching shaft has mounting collars at its ends and is axially movable in a bore in the housing which is arranged substantially at right angles to the tappets of the multi-port valves.

3. Apparatus according to claim 1, wherein the shaft-displacing means comprise a switching piston supported on an outer end portion of the switching shaft.

4. Apparatus according to claim 1, wherein an inner end portion of the switching shaft has an axial bore which receives part of the switching spring as well as a centering pin lying within the switching spring.

5. Apparatus according to claim 1, wherein the switching shaft has a recess of parallelogram shape in the outer surface of the shaft to receive a peg serving as the shaft-rotating means, the peg being secured in the housing so as to bear against an inclined guide face of the recess in order to cause the switching shaft to rotate upon axial displacement of the shaft.

6. Apparatus according to claim 1, wherein the switching shaft is guided in the axial direction by a radially-directed, spring-loaded guide pin which engages sequentially in two longitudinal grooves of V-shaped cross-section which extend parallel to each other along the outer surface of the switching shaft.

7. Apparatus according to claim 1, wherein the stop pins are arranged in the housing on the opposite side of the switching shaft to that of the tappets, the stop pins each being loaded by a compression spring acting in the direction of the switching shaft.

8. Apparatus according to claim 1, wherein, in each switching position, a stop pin engages a shoulder provided on the switching shaft.

9. Apparatus according to claim 7, wherein a portion of each stop pin extends into a respective hydraulically-chargeable pressure chamber and has a stepwise reduced stem which increases in cross-section in the direction of its respective loading spring, each pressure chamber being arranged to surround the said portion of its associated stem in a fluid-tight manner.

10. Apparatus according to claim 1, wherein the switching cams are arranged on the switching shaft to cause retraction of hydraulic cylinders of the mine-roof support in a first switching position of the switching shaft and to cause extension of hydraulic cylinders of the mine-roof support in a second switching position of the switching shaft.

11. Apparatus according to claim 10, wherein the stop pin which engages the switching shaft in the first switching position of the switching shaft is acted on in an associated pressure chamber by a pressure impulse which emanates from a limit switch provided on a first one of the hydraulic cylinders of the mine-roof support.

12. Apparatus according to claim 10, wherein the stop pin which engages the switching shaft in the second switching position of the switching shaft is acted upon in an associated pressure chamber by pressure in a second one of the hydraulic cylinders of the mine-roof support.

13. Apparatus according to claim 1, wherein the switching shaft is adapted to be rotated and returned from each switching position into its initial position of rest by means of a stop pin which is hydraulically acted upon by a respective switching piston and which engages, eccentrically of the axis of rotation of the switching shaft, in a longitudinal groove of the shaft.

14. Apparatus according to claim 13, wherein the said stop pin which causes the switching shaft to rotate is acted on through the respective switching piston by pressure from a pressure-supply line.

* * * * *